US011820550B2

(12) United States Patent
Johnson

(10) Patent No.: US 11,820,550 B2
(45) Date of Patent: Nov. 21, 2023

(54) PLASTIC FREE CONTAINER

(71) Applicant: Alexander Johnson, Grandview, OH (US)

(72) Inventor: Alexander Johnson, Grandview, OH (US)

( * ) Notice: Subject to any disclaimer, the term of this patent is extended or adjusted under 35 U.S.C. 154(b) by 32 days.

(21) Appl. No.: 17/337,092

(22) Filed: Jun. 2, 2021

(65) Prior Publication Data

US 2022/0388716 A1 Dec. 8, 2022

(51) Int. Cl.

| | |
|---|---|
| ***B65D 43/02*** | (2006.01) |
| ***B65D 13/02*** | (2006.01) |
| ***B65D 25/54*** | (2006.01) |

(52) U.S. Cl.

CPC ..... *B65D 13/02* (2013.01); *B65D 25/54* (2013.01); *B65D 43/0222* (2013.01); *B65D 2543/00092* (2013.01); *B65D 2543/00101* (2013.01); *B65D 2543/00305* (2013.01); *B65D 2543/00537* (2013.01)

(58) Field of Classification Search

CPC . B65D 11/105; B65D 11/188; B65D 11/1886; B65D 65/38; B65D 2543/00537; B65D 2543/00305; B65D 2543/00101; B65D 2543/00092; B65D 43/0222; B65D 25/54; B65D 13/02

USPC ..... 220/4.24, 4.21; 206/524.6

See application file for complete search history.

(56) References Cited

U.S. PATENT DOCUMENTS

| | | | | |
|---|---|---|---|---|
| 3,032,228 | A * | 5/1962 | Andrews | B65D 11/02 206/823 |
| 5,575,848 | A * | 11/1996 | Chedville | A47J 43/22 118/19 |
| 7,784,638 | B2 * | 8/2010 | Kishbaugh | A47G 19/02 220/573.1 |
| 10,015,985 | B1 * | 7/2018 | Blakely, III | A24F 5/00 |
| 2012/0205376 | A1 * | 8/2012 | Yang | B65D 77/245 220/735 |
| 2013/0153462 | A1 * | 6/2013 | Hara | H01L 21/67379 206/711 |
| 2018/0311111 | A1 * | 11/2018 | Knobel | B65D 1/34 |
| 2019/0307646 | A1 * | 10/2019 | Knobel | B65D 21/0222 |

FOREIGN PATENT DOCUMENTS

GB 285526 A * 2/1928

OTHER PUBLICATIONS

Tupperware, screenshot of homepage, accessed Sep. 2, 2021, 3 pages.

(Continued)

*Primary Examiner* — King M Chu

(74) *Attorney, Agent, or Firm* — Standley Law Group LLP; Jeffrey S. Standley; Kenny W. Pung

(57) ABSTRACT

A rigid container that may be used to store items. The container includes a first bowl and a second bowl. The first and second bowls both include center portions and at least one sidewall. The sidewalls are disposed about the peripheries of their respective center portions and oriented perpendicular to it. The sidewall(s) of the first bowl define an exterior profile and the sidewall(s) of the second bowl define an interior profile. The exterior profile and the interior profile are identical in shape but the interior profile is slightly larger so that the second bowl can be received over the first bowl.

8 Claims, 10 Drawing Sheets

(56) References Cited

OTHER PUBLICATIONS

Alpha Rho, Friction Fit Plastic Craft Boxes and Lids—Item No. 8B, screenshot of webpage, accessed Sep. 20, 2021, 2 pages.
BCW Supplies, 2 Piece Slider Box—50 Count, screenshot of webpage, accessed Sep. 20, 2021.

* cited by examiner

PLASTIC FREE CONTAINER

CROSS-REFERENCE TO RELATED APPLICATIONS

This application is a nonprovisional patent application that makes no priority claim.

TECHNICAL FIELD

Exemplary embodiments relate generally to containers for storing items, particularly, plastic free containers having a first bowl and a second bowl, wherein the two bowls combine in a close fit to form the container.

BACKGROUND

Plastic containers are widely used to store/contain items of ostensibly any variety. However, the use of plastics has become less desirable due to the by-and-large poor biodegradability of the material. Today, it is known that post-use plastic often ends up as environmental pollution in undesired areas (e.g., landfills, oceans, city streets, etc.). In addition, consumer-level plastic containers are often lacking in durability. This leads to frequent replacement, which in turn increases the amount of plastic waste generated.

One type of item commonly stored in plastic containers is food. This includes single-use plastic containers such as wrappers and take-out boxes, as well as reusable plastic containers such as Tupperware (available from Tupperware Brands Corporation of Orlando, Fla.). While such containers may be adequate for storing food, they are often not ideal for the preparation of food prior to consumption. This is because plastic containers are typically vulnerable to deformation upon the application of heat (e.g., when microwaving the food or heating in an oven). Further, plastic containers can also be a source of chemical toxins (e.g., bisphenol A, phthalates, etc.) that can leach into food, especially when exposed to heat. Thus, for at least these reasons, it is contemplated that a heat-safe food storage solution that does not contain plastic would be desired.

SUMMARY OF THE INVENTION

Disclosed are containers for storing items that includes a first bowl and a second bowl.

In one embodiment of the present disclosure, the container includes a first bowl that includes a center portion and a cylindrical sidewall disposed along the periphery of the center portion. The sidewall of the first bowl is oriented perpendicular to the center portion of the first bowl. The sidewall of the first bowl includes an exterior surface that defines an exterior profile. The container also includes a second bowl that includes a center portion and a cylindrical sidewall disposed along the periphery of the center portion. The sidewall of the second bowl is oriented perpendicular to the center portion of the second bowl. The sidewall of the second bowl comprises an interior surface that defines an interior profile. The exterior profile of the first bowl is identical in shape to the interior profile of the second bowl. The interior profile of the second bowl is larger than the exterior profile of the first bowl such that the second bowl is receivable over the first bowl.

In another embodiment of the present disclosure, the container includes a first bowl that includes a center portion and a plurality of sidewalls. The sidewalls of the first bowl are disposed about the periphery of the center portion of the first bowl and are oriented perpendicular to it. Each sidewall of the first bowl includes an exterior surface and the exterior surfaces of the sidewalls collectively define an exterior profile. The container also includes a second bowl that includes a center portion and a plurality of sidewalls. The sidewalls of the second bowl are disposed about the periphery of the center portion of the second bowl and are oriented perpendicular to it. Each sidewall of the second bowl includes an interior surface and the interior surfaces of the sidewalls collectively define an interior profile. The shape of the interior profile of the second bowl is identical to the shape of the exterior profile of the first bowl. The interior profile of the second bowl is larger than the exterior profile of the first bowl such that the second bowl is receivable over the first bowl.

In yet another embodiment of the present disclosure, the container includes a first bowl that includes a center portion and a cylindrical sidewall disposed along the periphery of the center portion. The sidewall of the first bowl is oriented perpendicular to the center portion of the first bowl. The sidewall of the first bowl includes an exterior surface that defines an exterior profile that is circular in shape. The container also includes a second bowl that includes a center portion and a cylindrical sidewall disposed along the periphery of the center portion. The sidewall of the first bowl is oriented perpendicular to the center portion of the first bowl. The sidewall of the second bowl includes an interior surface that defines an interior profile that is circular in shape. The first bowl and the second bowl both include a glass material composition. The interior profile of the second bowl is larger than the exterior profile of the first bowl such that the second bowl is receivable over the first bowl in either a clearance fit or a transition fit.

Other examples of the disclosed container will become apparent from the following detailed description, the accompanying drawings and the appended claims.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Figure 1:
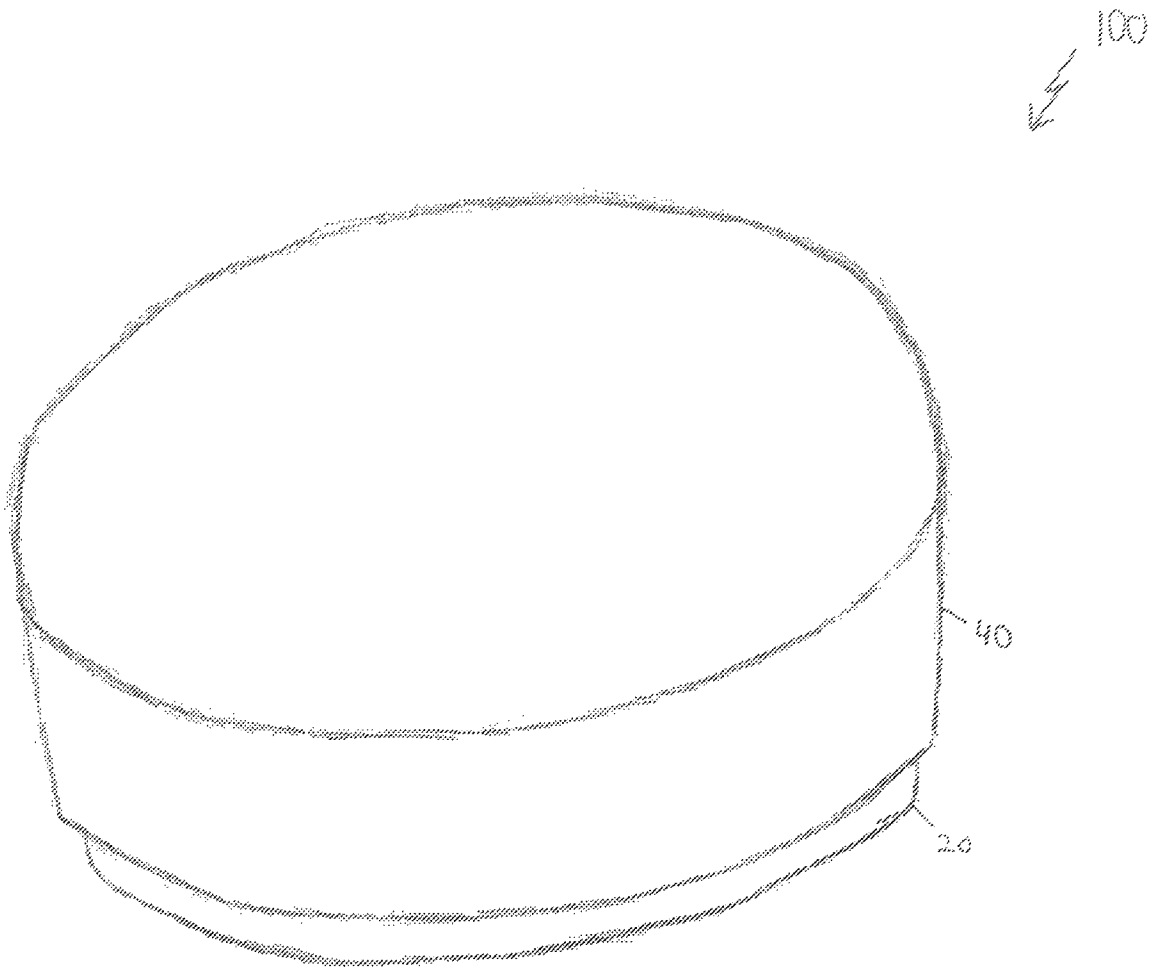
FIG. 1 is a perspective view of a first embodiment of a container for storing items.
Figure 2:
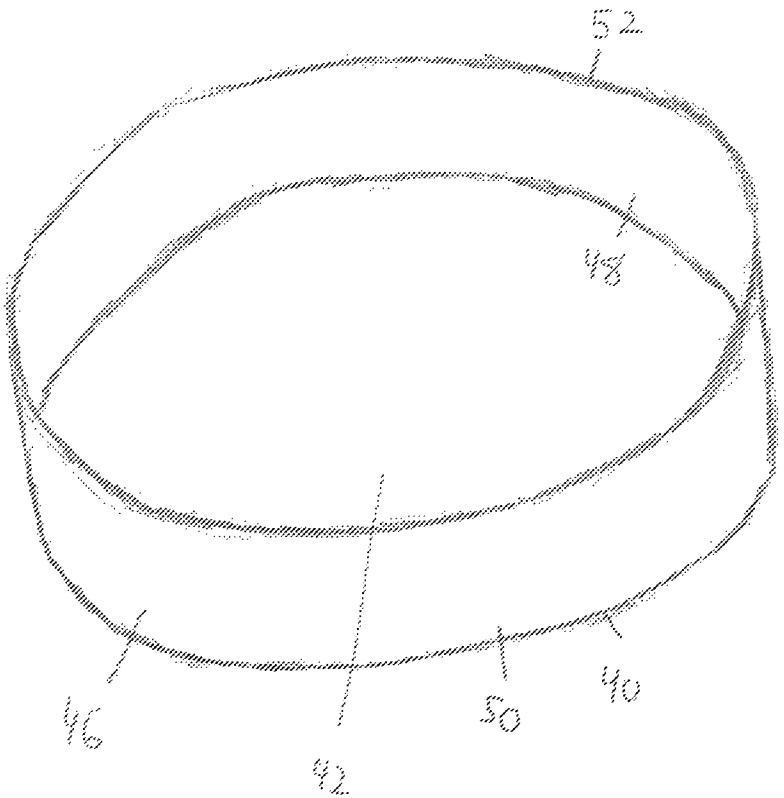
FIG. 2 is a perspective view of the first and second bowls of the container of FIG. 1.
Figure 2:
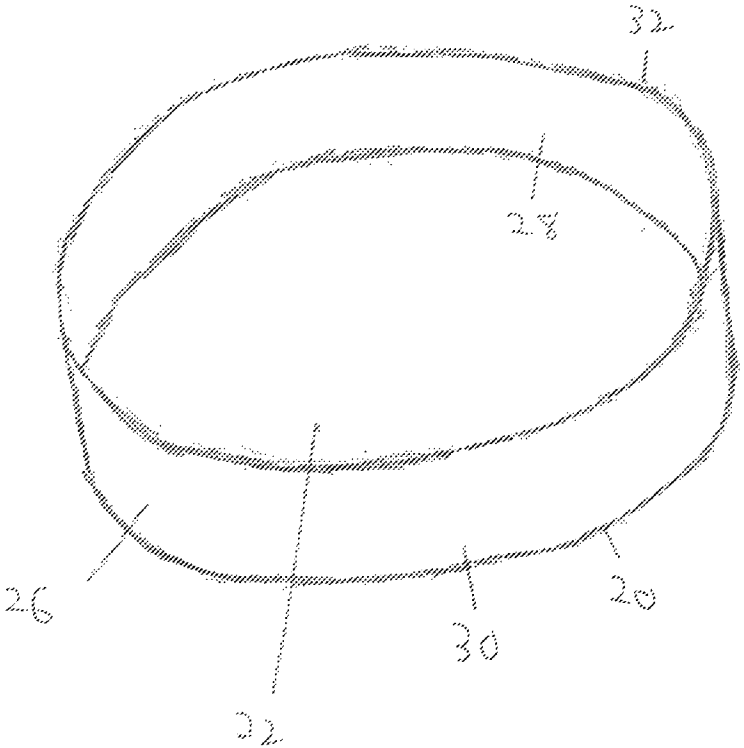
Figure 3:
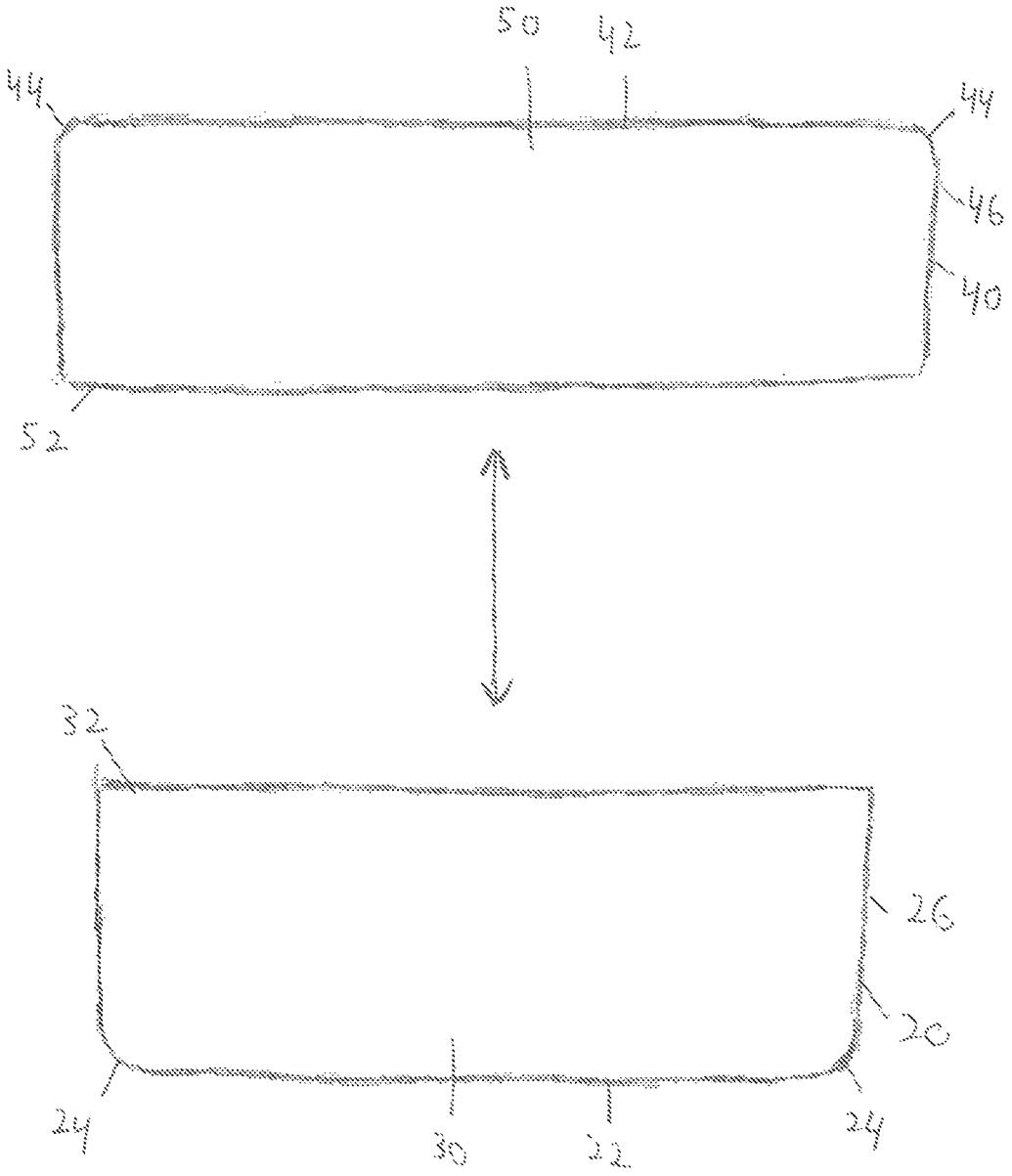
FIG. 3 is a front elevation view of the first and second bowls of FIG. 1.
Figure 4:
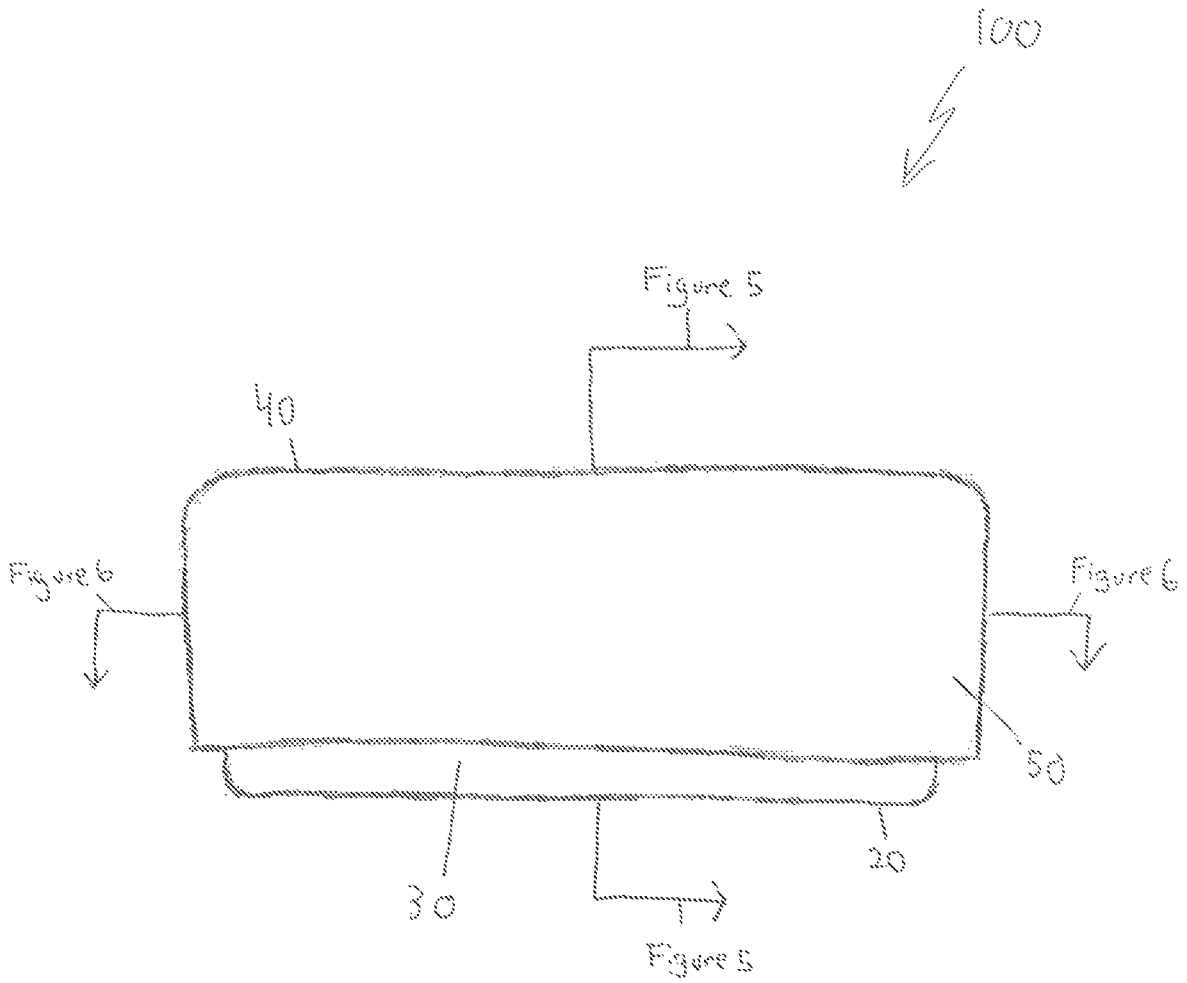
FIG. 4 is a front elevation view of the container of FIG. 1.
Figure 5:
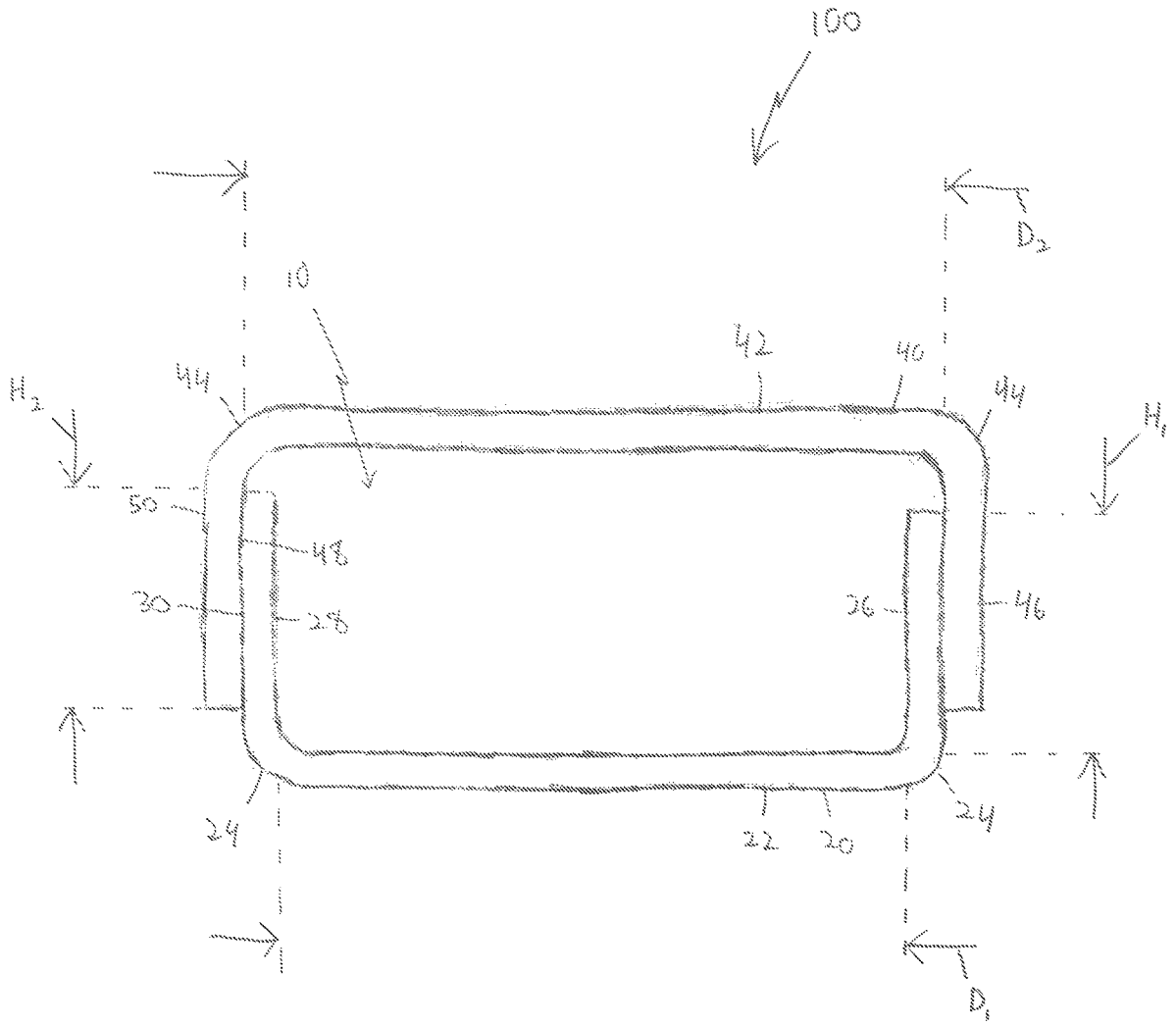
FIG. 5 is a side cross-sectional view of the container of FIG. 1.

Referring to FIG. 1, shown is an embodiment of a container 100 for storing items. The container 100 may be used to store any suitable item such as, but not limited to, food. The container 100 includes a first bowl 20 and a second bowl 40 (FIG. 2). The second bowl (i.e., top bowl) function as a lid for the first bowl (i.e., bottom bowl). Items may be securely retained within the container 100 by placing the items into the first bowl 20 and receiving the second bowl 40 over the first bowl 20 (FIG. 3). The first and second bowls 20, 40 collectively define a container interior 10 therebetween (FIG. 5). Due to the relatively tight fit between the first bowl 20 and the second bowl 40, the second bowl 40 is not easily removed once it has been received over the first bowl 20 even without the use of plastic components (e.g., seals, lids, etc.).

The first bowl 20 and the second bowl 40 may be fabricated out of any suitable material. However, it is contemplated that high rigidity materials such as glass, ceramic, or metal may be preferred due to their generally higher degree of durability compared to plastic. Moreover, such materials may also be better suited for containing food items as they are being prepared for consumption. Glass (e.g., tempered soda lime glass, borosilicate glass, etc.), in particular, may be preferred since it can be transparent, chemically inert, and generally will not deform nor leach chemical toxins when exposed to heat (e.g., when storing hot food, when microwaved, or when placed in an oven).

The container of FIGS. 1-7 is circular in shape. Here, the first bowl 20 includes a circular center portion 22 and a cylindrical sidewall 26 disposed along the periphery of the center portion 22. The sidewall 26 of the first bowl 20 is oriented perpendicular relative to the center portion 22 and may define a gentle curved edge 24 therebetween (FIG. 5). The second bowl 40 is similar to the first bowl 20. The second bowl 40 also includes a circular center portion 42 and a cylindrical sidewall 46 disposed along the periphery of the center portion 42. The sidewall 46 of the second bowl 40 is also oriented perpendicular relative to the center portion 42 and may define a gentle curved edge 44 therebetween.

Figure 6:
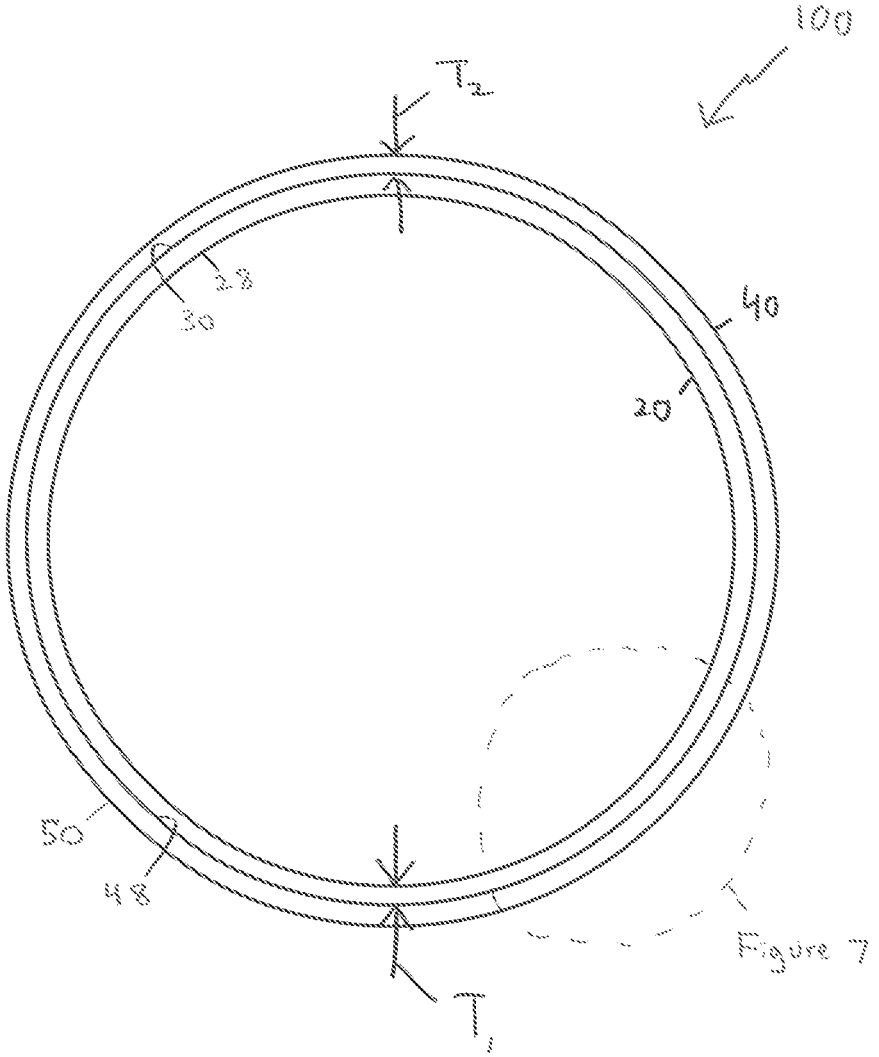
FIG. 6 is a top cross-sectional view of the container of FIG. 1.

The sidewalls of the first and second bowls 20, 40 define a circular profile (FIG. 6). As used herein, the term "profile" refers to the shape defined by the sidewalls when viewed from either the top or bottom. Further, there are interior profiles and exterior profiles. Interior profiles are defined by the interior surfaces 28, 48 of the sidewalls whereas the exterior profiles are defined by the exterior surfaces 30, 50 of the sidewalls. For example, the cylindrical sidewall 26 of the first bowl 20 defines a circular interior profile and a circular exterior profile. Since this sidewall 26 is consistent in thickness, the interior and exterior profiles are consistent in size (e.g., circumference) from the center portion 22 to the rim 32 (i.e., along the height of the sidewall 26).

Preferably, the interior profile of the second bowl 40 should be identical in shape to the exterior profile of the first bowl but slightly larger. That is to say, the minimum dimensions (i.e., diameter, length and width, etc.) of the interior profile of the second bowl 40 should be greater than the maximum dimensions of the exterior profile of the first bowl 20. By this design, it can be certain that the second bowl 40 can be received over (i.e., fitted onto) the first bowl 20.

It is also contemplated, however, that the first bowl 20 and the second bowl 40 should come together in a close fit (i.e., between the sidewalls 26, 46 of the first and second bowls 20, 40). In practice, such a close fit would ensure that the first and second bowls 20, 40 can only be combined or separated by maneuvering the bowls directly up or down (FIG. 3). By this design, it is less likely that a random force or impact, which may come from any direction, will be able to dislodge the second bowl 40 from the first bowl 20.

In addition, it is also contemplated that a close fit between the sidewalls 26, 46 of the first and second bowls 20, 40 may help to retain the second bowl 40 on the first bowl 20 by limiting the rate in which air is able to flow into the container interior 10. When the second bowl 40 is lifted off the first bowl 20 faster than air can fill the container interior 10 (which is increasing in volume as the second bowl 40 is being lifted), vacuum pressure builds within the container interior 10 that resists the removal of the second bowl 40. In effect, this ensures that the second bowl 40 will not be removed from the first bowl 20 in an accidental or haphazard manner, thereby securely retaining the items within the container interior 10 without the need for plastic seals or plastic press-fit lids.

Figure 7:
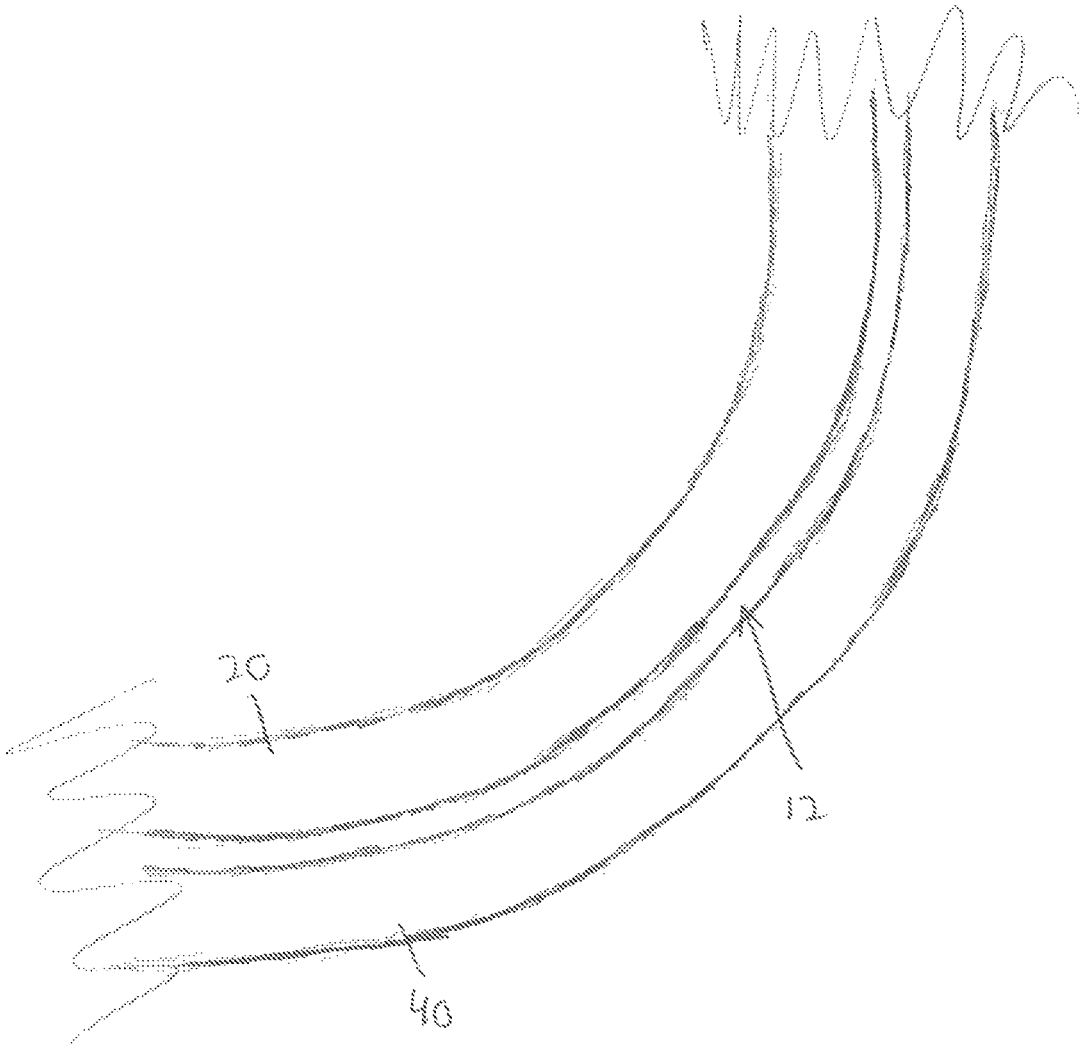
FIG. 7 is a close-up view of a portion of the cross-section shown in FIG. 6.

The degree to which the interior profile of the second bowl 40 is larger than the exterior profile of the first bowl 20 may vary without departing from the scope of the present disclosure. Preferably, the second bowl 40 should fit (i.e., slide) over the first bowl 20 in either a clearance fit or a transition fit. This is because an interference fit would not provide the necessary tolerance required to reasonably combine or separate the first and second bowls 20, 40. A degree of tolerance 12 may be provided, at least in some places, between the sidewalls of the first and second bowls (FIG. 7). For example, a suitable degree of tolerance 12 may range from about $1/64^{th}$ of an inch to about $5/64^{th}$ of an inch, or even more preferably about $1/32^{nd}$ of an inch to about $1/16^{th}$ of an inch. A distance measured between the interior profile of the second bowl and the exterior profile of the first bowl may range from about 0.02 inches and about 0.2 inches, measured at a point between the two profiles.

The relative dimensions of the first bowl 20 relative to the second bowl 40 may vary without departing from the scope of the present disclosure. For example, in one embodiment the sidewalls 46 of the second bowl 40 may define a height $H_2$ that is about 60% to about 90% of the height $H_1$ of the sidewalls 26 of the first bowl 20, or more preferably about 75% of the height $H_1$ of the first bowl 20. In another embodiment, the center portion 42 of the second bowl 40 may define an area (i.e., square inches) ranging from about 5% to about 20% of the area of the center portion 22 of the first bowl 20.

In one embodiment, the container 100 may include a first bowl 20 having a circular center portion 22 that is 7.5 inches in diameter $D_1$, with sidewalls 26 having a height $H_1$ of 3.25 inches, and a thickness $T_1$ of about 0.1875 inches. The second bowl 40 of this embodiment may have a circular center portion 42 that is 7.875 in diameter $D_2$, with sidewalls 46 having a height $H_2$ of 2.43 inches and a thickness $T_2$ of about 0.1875 inches.

Particularly in the context of food items, it is contemplated that the second bowl 40 can have greater utility than just being a lid. For example, the second bowl 40 can also be useful as a separate serving container for portioning out or distributing the food items. Further, the second bowl 40 can also be received under the first bowl 20 such that the center portion 42 of the second bowl 40 is proximate the center portion 22 of the first bowl 20. This may be particularly useful if the first bowl 20 is hot to the touch due to food preparation (e.g., microwaving or heating in an oven).

At this point, those skilled in the art will appreciate that the container of the present disclosure can be formed in various other shapes (e.g., ovoid, polygonal, or even irregular shapes) much in the same way as the container of FIGS. 1-7. For example, an ovoid container would be similar in design to the circular container previously shown except with first and second bowls having ovoid center portions and elliptic cylindrical sidewalls. These sidewalls may be oriented perpendicular to their center portions and define circular interior and exterior profiles. The first and second bowls may be sized and shaped such that a clearance fit or a transition fit is provided between them.

Figure 8:
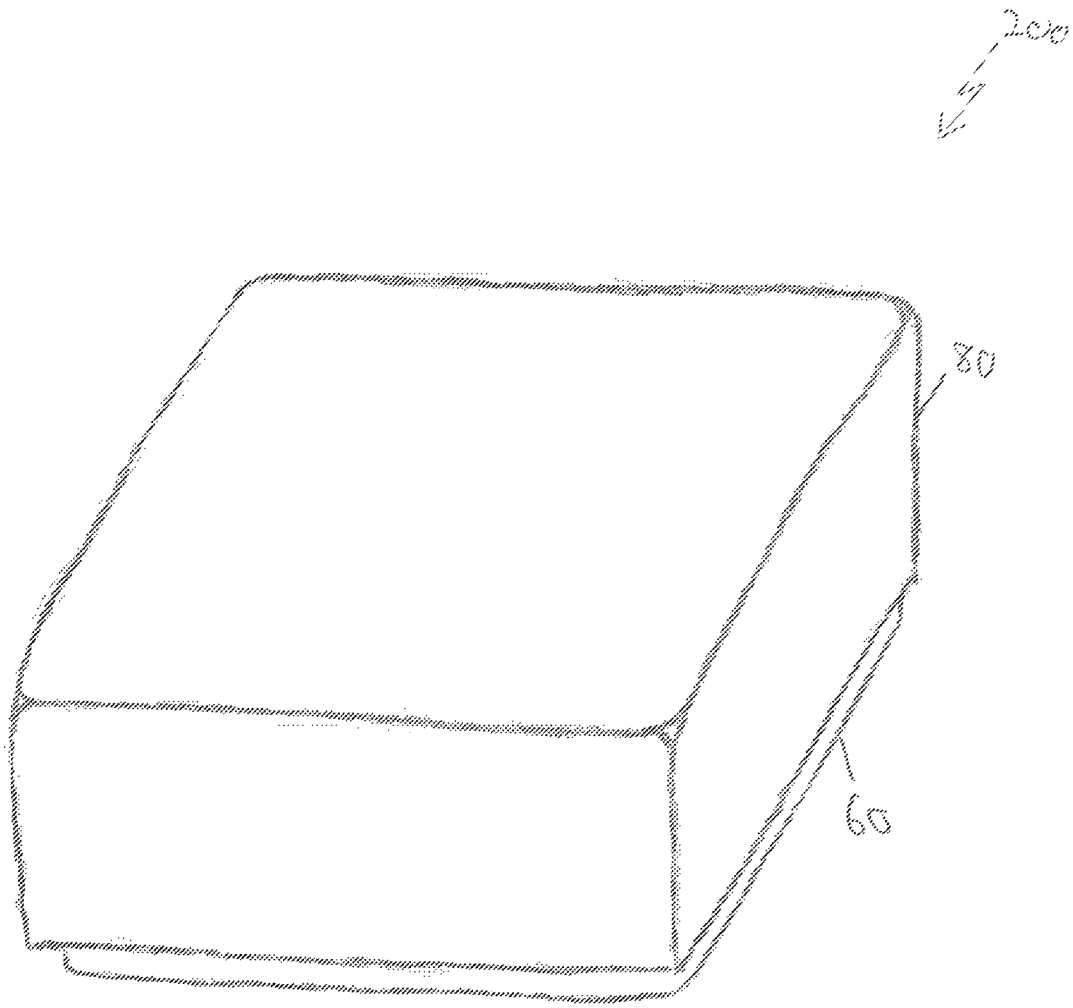
FIG. 8 is a perspective view of a second embodiment of a container for storing items.
Figure 9:
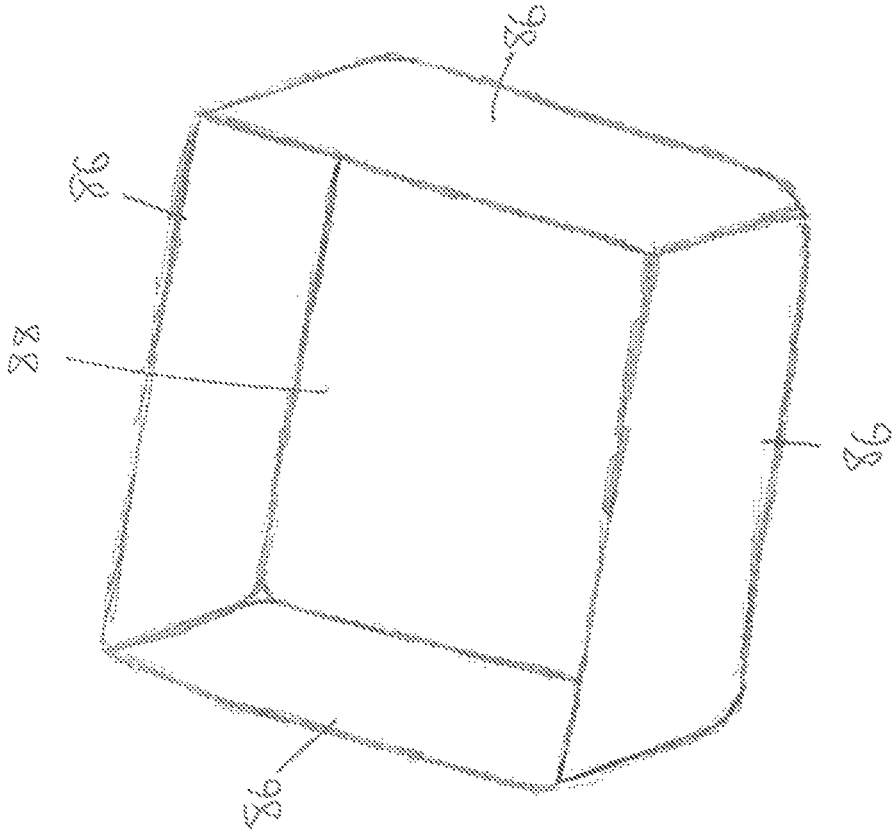
FIG. 9 is a perspective view of the first and second bowls of the container of FIG. 8.
Figure 9:
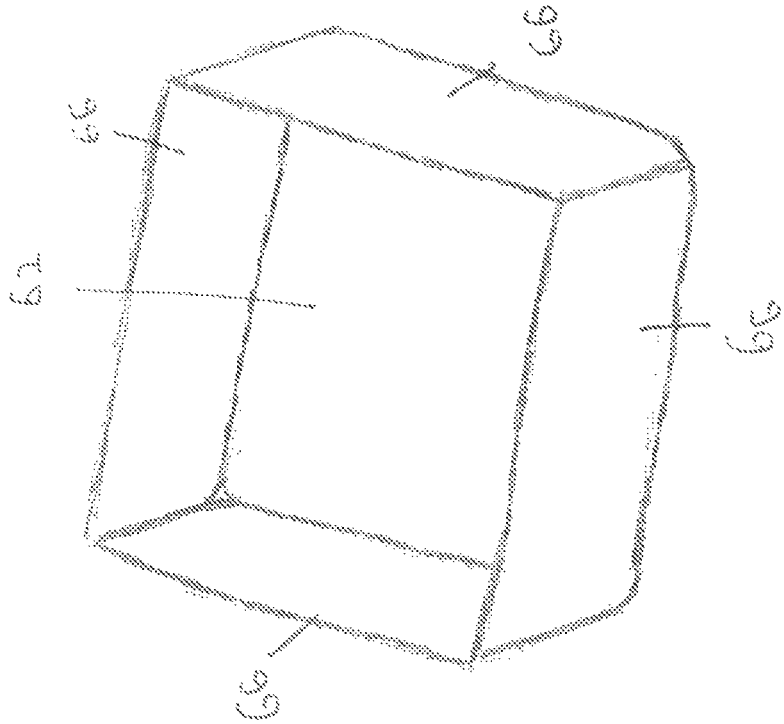

Polygonal containers (e.g., triangular, rectangular, hexagonal, etc.) would include first and second bowls having a polygonal center portions and multiple sidewalls. For example, as shown to FIGS. 8 and 9, a square container 200 may include first and second bowls 60, 80 having square center portions 62, 88 and four sidewalls 66, 86 disposed around the peripheries of the center portions 62, 88. These sidewalls 66, 86 may be oriented perpendicular to their center portions 62, 88 and define square interior and exterior profiles. These sidewalls 66, 86 may, but need not, be planar. The first and second bowls 60, 80 may be sized and shaped such that a clearance fit or a transition fit is provided between them.

Figure 10:
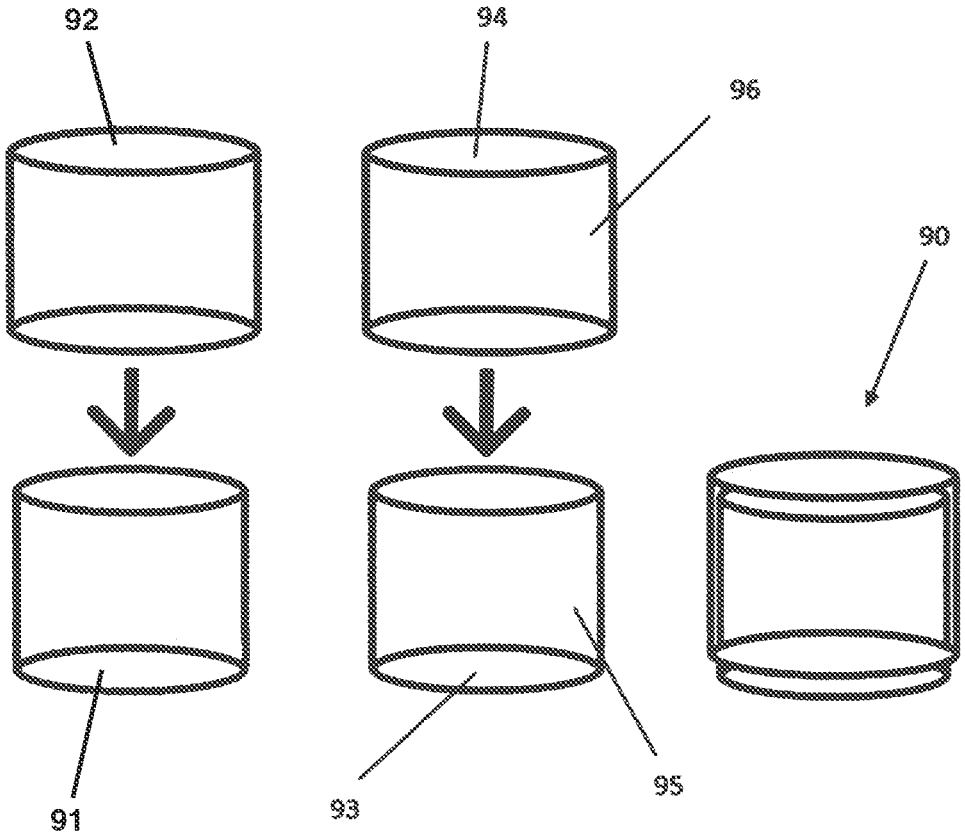
FIG. 10 is a front elevation view of a third embodiment of a container for storing items.

Referring to FIG. 10, shown is an exemplary embodiment of the container 90 that features a circular shape and a transparent glass material composition. Transparency may be preferred because it enables the people to look into the container interior and quickly discern the contents (which is distinguishable from plastic lids because plastic lids are typically colored or opaque, making it difficult to see the contents of the container from above). This container 90 includes first and second bowls 91, 92 having center portions 93, 94 and cylindrical sidewalls 95, 96 disposed along the periphery of the center portions 93, 94. The sidewalls 95, 96 are oriented perpendicular to their center portions 93, 94 and define circular interior and exterior profiles. The interior profile of the second bowl 92 is larger than the exterior profile of the first bowl 91 so that the second bowl 92 can be received over the first bowl 91.

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A container comprising:

a first glass bowl comprising a first center bottom portion and a first cylindrical sidewall disposed along the entire periphery of the first center bottom portion, wherein the first sidewall is oriented perpendicular to the first center bottom portion defining an opening of said first bowl, and the first sidewall comprises an exterior surface that defines an exterior profile circular in shape;

a second glass bowl that is receivable over the first sidewall of the first bowl, the second bowl comprising a second center bottom portion and a second cylindrical sidewall disposed along the entire periphery of the second center bottom portion, wherein the second sidewall is oriented perpendicular to the second center bottom portion defining an opening of said second bowl, and the second sidewall comprises an interior surface that defines an interior profile circular in shape;

wherein the interior diameter of the second bowl is larger than the exterior diameter of the first bowl by about 0.02 inches to about 0.2 inches, such that the opening of the second bowl is configured to be inverted and to fit over the opening of the first bowl thereby enclosing said first bowl; wherein the thickness of the first and second containers are consistent from the center portion to the rim of the sidewall; a curved edge between the sidewall and the center portion of both the first and second containers.

2. The container of claim 1 wherein at least one of the first bowl and the second bowl is transparent.

3. The container of claim 1 wherein:

the first sidewall of the first bowl comprises a first height;

the second sidewall of the second bowl comprises a second height; and the second height of is about 60% to 90% of the first height.

4. The container of claim 1 wherein the first sidewall and the second sidewall are each of a height ranging from about 2.43 inches to about 3.25 inches.

5. The container of claim 1 wherein the first center portion and the second center portion each have a diameter ranging from 6 inches to 9 inches.

6. The container of claim 1 wherein the thickness of the first and second sidewalls is about 0.1875 inches.

7. A container comprising:

a first bowl comprising a first center portion and a first continuous sidewall that fully encompasses said center portion of said first bowl, the first sidewall being disposed about the periphery of the center portion and oriented perpendicular to it, wherein said first continuous sidewall comprises an exterior surface that defines an opening and an exterior profile;

a second bowl comprising a second center portion and a second continuous sidewall that fully encompasses said second center portion of said second bowl, the second sidewall being disposed about the periphery of the second center portion and oriented perpendicular to it, wherein said second sidewall comprises an interior surface that defines an interior profile;

wherein the shape of the interior profile of the second bowl is substantially identical to the shape of the exterior profile of the first bowl;

wherein the first bowl and the second bowl are comprised of glass; and wherein the interior profile dimensions of the second bowl is are larger than the exterior profile dimensions of the first bowl by about 0.02 inches to about 0.2 inches in each direction, such that the second bowl is configured to be inverted and fit over the opening of the first bowl thereby enclosing said first bowl; wherein the thickness of the first and second containers are consistent from the center portion to the rim of the sidewall; a curved edge between the sidewall and the center portion of both the first and second containers.

8. The container of claim 7 wherein the interior profile of the first bowl and the profile of the second bowl are polygonal in shape.

* * * * *